US005308249A

United States Patent [19]

Renn et al.

[11] Patent Number: 5,308,249

[45] Date of Patent: May 3, 1994

[54] BACKPLANE CONNECTOR UTILIZING FLEXIBLE FILM CIRCUITRY

[75] Inventors: Robert M. Renn, Pfafftown; Robert D. Irlbeck, Greensboro; Frederick R. Deak, Kernersville; Keith L. Volz, Jamestown; David C. Johnson; Warren A. Bates, both of Winston-Salem, all of N.C.

[73] Assignee: The Whitaker Corporation, Wilmington, Del.

[21] Appl. No.: 78,665

[22] Filed: Jun. 16, 1993

[51] Int. Cl.[5] ..... H01R 9/09

[52] U.S. Cl. ..... 439/62; 439/637

[58] Field of Search ..... 439/62, 637, 67, 493, 439/632

[56] References Cited

U.S. PATENT DOCUMENTS

| | | | |
|---|---|---|---|
| 3,772,775 | 11/1973 | Bonnke et al. | 439/67 |
| 4,969,824 | 11/1990 | Casciotti | 439/62 |
| 5,145,381 | 9/1992 | Volz | 439/62 |
| 5,156,553 | 10/1992 | Katsumata et al. | 439/62 |
| 5,171,154 | 12/1992 | Casciotti et al. | 439/62 |

*Primary Examiner*—Gary F. Paumen
*Attorney, Agent, or Firm*—William B. Noll

[57] ABSTRACT

The invention is directed to an electronic assembly, such as a backplane assembly of the type including a mother board, a connector housing mounted on the mother board, and a daughter board slidably insertable into the connector housing for electrical interconnection to the mother board. The assembly comprises an elongated connector housing having a pair of parallelly disposed spaced apart housing members defining at least one slot therebetween for receiving the daughter board. A force generating member is disposed within the slot, where the force generating members comprises a pair of resilient, essentially L-shaped members. One leg of each of the L-shaped members is fixedly disposed between the mother board and the housing members, while the others of the legs upstand within the slot in a spaced apart relationship to receive the daughter board therebetween, the upstanding legs including at least one pair of opposing elastomeric members to apply a compressive pressure to said daughter board. Further, a flexible circuit element is mounted on the force generating member and is operatively disposed to electrically interconnect the daughter board to the mother board. A preferred feature thereof is the provision of a camming means on the upstanding legs to allow insertion of the daughter board without causing damage to the circuitry on the flexible circuit element, preferable in the form of a flat film.

8 Claims, 4 Drawing Sheets

10
36
34
38
47
49
14
16
50
50
52
41
38
70
72
52
45
38
43

BACKPLANE CONNECTOR UTILIZING FLEXIBLE FILM CIRCUITRY

The present invention is directed to an electronic assembly, such as a backplane assembly, more particularly to the electrical interconnection of a "mother" board and a "daughter" board wherein flexible film having circuitry thereon is utilized.

BACKGROUND OF THE INVENTION

A mother board and a daughter board are electrically interconnected to transfer digital signals between respective assemblies used in a computer or other electronic equipment, by way of example. The mother and daughter boards may be arranged perpendicular to each other, as in an "edge card" configuration, depending upon the design of the overall product.

In a variety of other product applications, the prior art has used compressible electrical connectors which are well known in the electronic industry. These compressible electrical connectors include a plurality of closely spaced conductive elements or traces photographically etched or otherwise formed on a flexible film which is bonded to an elastomeric core or other suitable carrier. Under its trademark "AMPLIFLEX", AMP Incorporated of Harrisburg, Pennsylvania, supplies a wide variety of such compressible electrical connectors to the electronic and aerospace industries.

Because of their relatively high circuit densities, it would be desirable to use these "AMPLIFLEX" compressible electrical connectors in certain product applications having mother/daughter board configurations. However, because the daughter board is slidably inserted into the mother board, perpendicularly thereof, the compressible electrical connector may become damaged inadvertently.

It is important, therefore, to have a very low or substantially zero insertion force (ZIF) to preclude damage to the compressible electrical connector. This is required for insertion of the boards during assembly of the equipment in production as well as withdrawal of the boards during maintenance and service of the equipment in the field.

In co-pending U.S. patent application Ser. No. 07/938,989, owned by the Assignee hereof, a ZIF type interconnection system is taught utilizing flexible film circuitry. The electrical assembly thereof includes a mother board, a connector body mounted on the mother board, and at least one compressible electrical connector carried by the connector body. A daughter board is arranged to be slidably inserted within the connector body and is disposed substantially perpendicularly to the mother board. The daughter board has respective sides and further has respective circuit elements electrically connected to the compressible electrical connector on the connector body. A deflection means is carried by the connector body and engages one of the sides of the daughter board to deflect the daughter board away from the compressible electrical connector as the daughter board is slidably inserted into the connector body. Further, a retaining means is provided to exert a lateral clamping force on the daughter bard and against the connector body, after the daughter board has been inserted into the connector body, thereby removably retaining the daughter board on the mother board.

Co-pending U.S. patent application Ser.No. 07/995,474, assigned to the assignee hereof, teaches another approach to a ZIF connector assembly for mother/daughter boards. More precisely, such co-pending application discloses a backplane connector having a mother board provided with a connector housing for receiving a daughter board perpendicularly thereof. A cam bump is provided on the daughter board to engage an inclined camming surface on the connector housing on the mother board, thereby deflecting the daughter board laterally away from a flexible electrical connector in the connector housing on the mother board. When the daughter board is fully seated within the connector housing on the mother board, the cam bump is received in a cam bump recess on the connector housing. A spring is provided on the connector housing to bias the daughter board towards the mother board thereby providing a detent action therebetween.

The present invention offers a still different approach in providing an electrical interconnection between a mother/daughter board utilizing flexible film having circuitry thereon as the interconnection means. This approach will become apparent in the description which follows, particularly when read in conjunction with the accompanying drawings.

SUMMARY OF THE INVENTION

This invention relates to an electronic assembly, preferably a backplane assembly of the type including a mother board, a connector housing mounted on said mother board, and a daughter board slidably insertable into the connector housing for electrical interconnection to the mother board. The assembly comprises an elongated connector housing having a pair of parallelly disposed spaced apart housing members defining at least one slot therebetween for receiving the daughter board. A force generating member is disposed within the slot, where the force generating member comprises a pair of resilient, essentially L-shaped members. One leg of each of the L-shaped members is fixedly disposed between the mother board and the housing members, while the others of the legs upstand within the slot in a spaced apart relationship to receive the daughter board therebetween, where the upstanding legs include at least one pair of opposing elastomeric members to apply a compressive pressure to said daughter board. Further, a flexible circuit element is mounted on the force generating member and is operatively disposed to electrically interconnect the daughter board to the mother board. A preferred feature thereof is the provision of a camming means on the upstanding legs to allow insertion of the daughter board without causing damage to the circuitry on the flexible circuit element, preferably in the form of a flat film.

BRIEF DESCRIPTION OF DRAWINGS

FIG. 3 is an enlarged, partial top view of the end of the force generating member of FIG. 2.

DETAILED DESCRIPTION OF PREFERRED EMBODIMENTS

Figure 1:
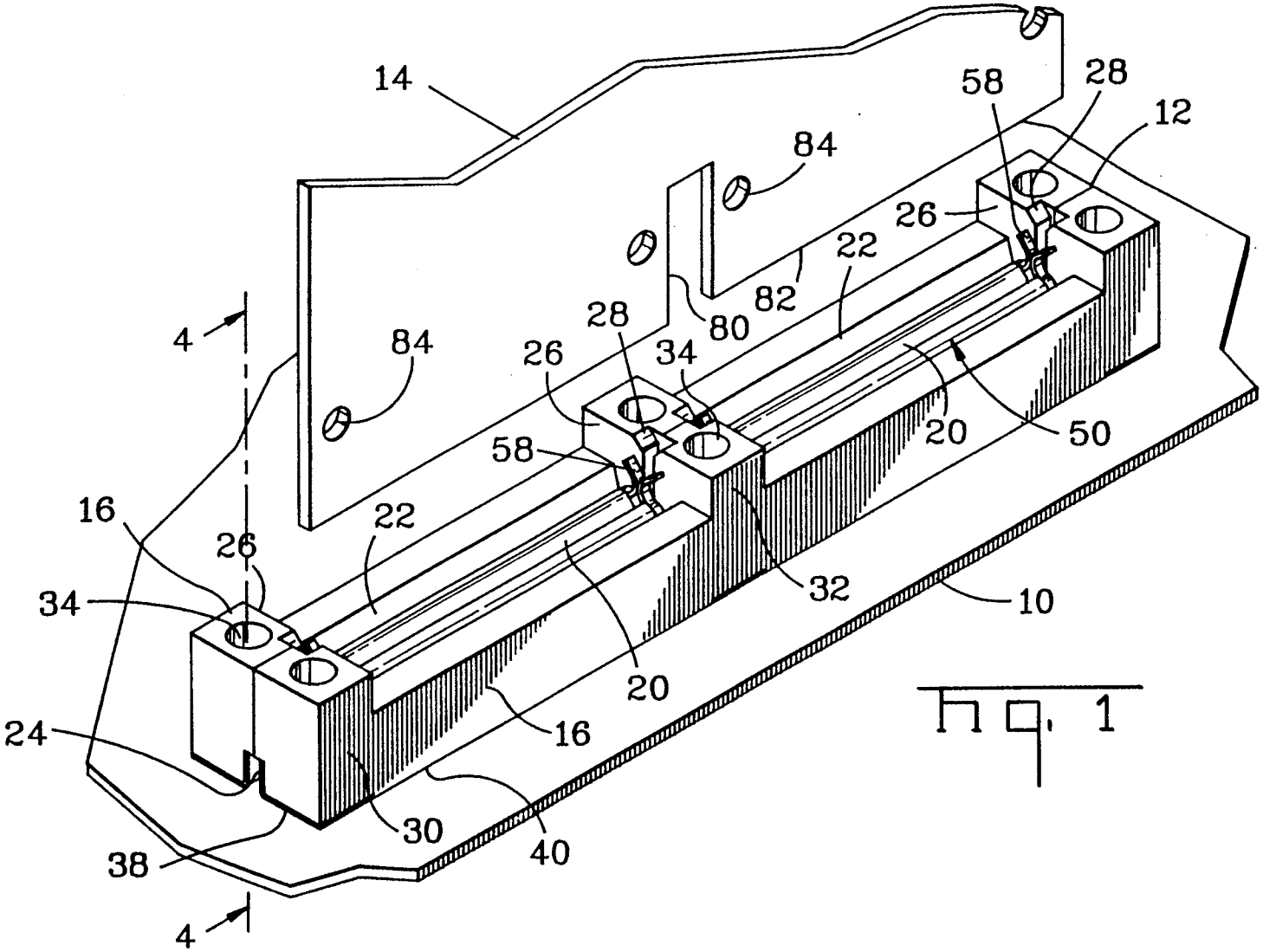
FIG. 1 is a perspective view of a backplane connector assembly according to this invention.

As illustrated in FIG. 1, this invention is directed to a backplane connector assembly of the type including a mother board 10, a connector housing 12 mounted in said mother board 10, and a daughter board 14 to be slidably received within said connector housing 12.

Considering the further details thereof, as shown in FIGS. 1–4, the connector housing comprises a pair of elongated housing members 16 designed and arranged to lie adjacent to one another to define at least one elongated, daughter board receiving slot 20 therebetween. In the preferred embodiment of FIG. 1, there are two aligned slots 20 for receiving a single daughter board 14. In any case, the slot 20 is further defined by sloping sides 22, where such sides 22 coverage toward the mating interface 24 between the connector housing 12 and mother board 10. At the respective ends 26 of the slots 20, a board guide in the form of tapered walls 28 may be provided. Disposed at each end 30, and in the middle portion 32 of the embodiment of FIG. 1, mounting holes 34 are provided for receiving fastening means 36 to secure the housing members 16 to the mother board 10, see FIG. 3. To facilitate such mounting, L-shaped mounting posts 38, stamped and formed from a sheet metal blank, may be provided within a recess along the base 40 and slot wall of the housing members 16 in alignment with the mounting holes 34.

The mounting posts 38, as best seen in FIG. 3, are joined by webs 41 to the L-shaped member 52, as hereinafter described. Each mounting post 38 includes upstanding flange leg 43 in which hole 45 is provided. The purpose of hole 45 is to receive bumps or projections 47 along the inside wall 49 of housing member 16, to secure same to the mother board 10, see FIG. 4.

Forming part of the connector housing 12, and lying within the slot or slots 20, there is found a force generating member 50 comprising a pair of L-shaped members 52 formed of a resilient material, such as plastic or metal, where one leg 54 thereof lies between the mother board 10 and housing base 40. The other leg 56 of the respective L-shaped members 52 are spaced apart and upstand between the housing members 16 within slot 20, see FIGS. 4–6. The ends 58 of such other leg 56 are provided with a formed camming surface 59 which cooperate to spread the other legs 56 upon entry therebetween by the daughter board 14, in a manner to be described hereinafter.

Figures 2, 4, 7:
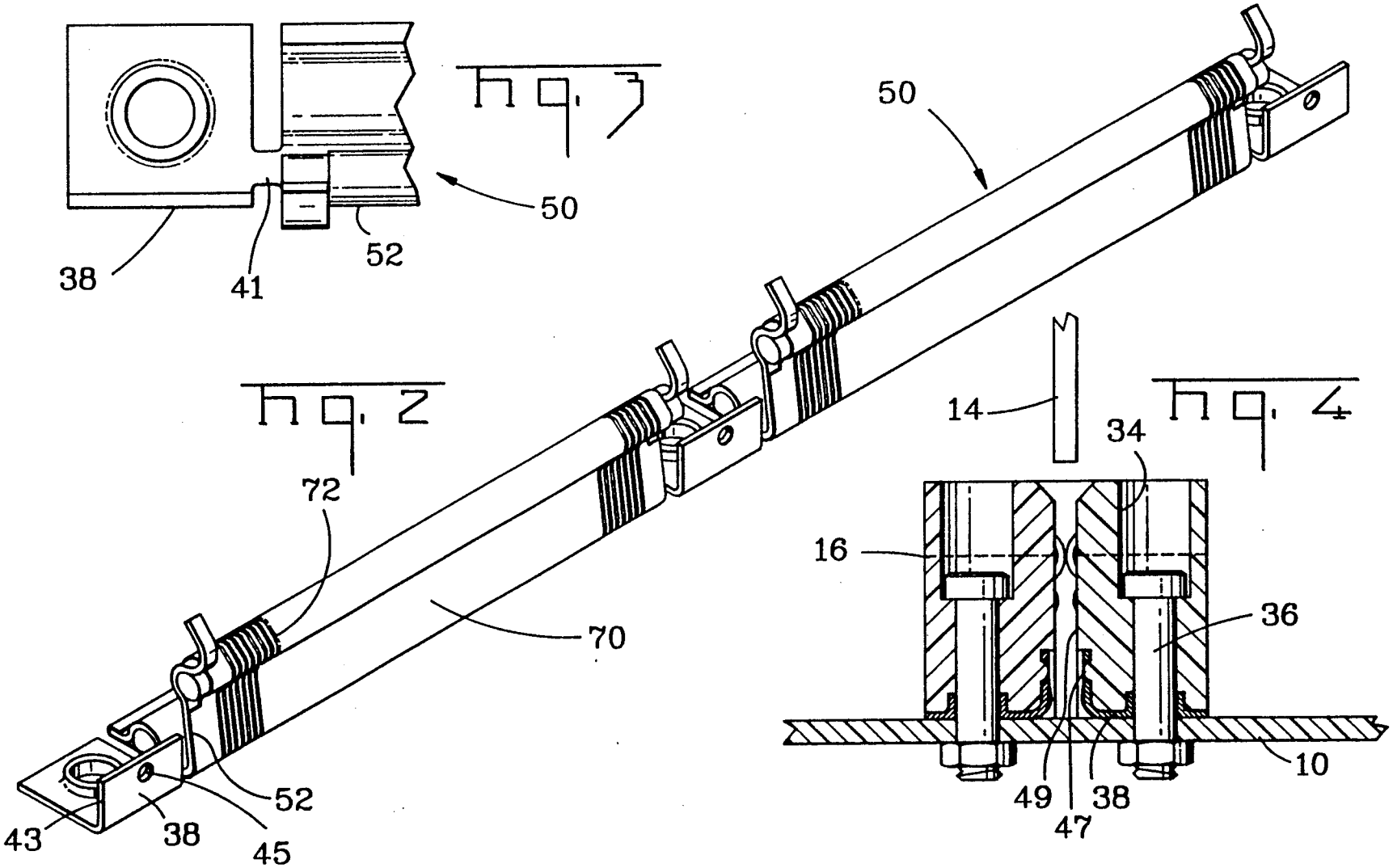
FIG. 2 is a perspective view of one of a pair of force generating members incorporated into the backplane connector assembly hereof.
FIG. 4 is a sectional view taken along line 4—4 of FIG. 1.
FIGS. 6–8 are sectional views representing the sequence of loading the backplane connector assembly of FIG. 1.
Figure 5:
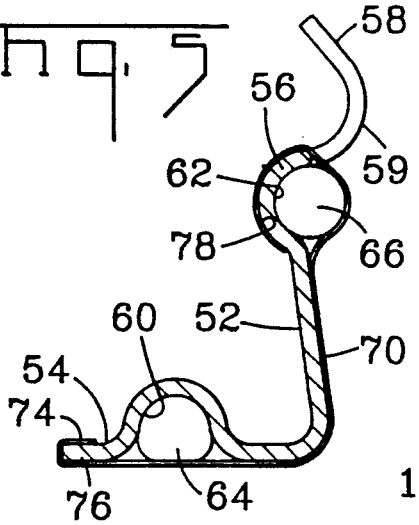
FIG. 5 is a sectional view of a preferred embodiment for a resilient spring member forming part of the force generating member illustrated in FIG. 2.
Figure 6:
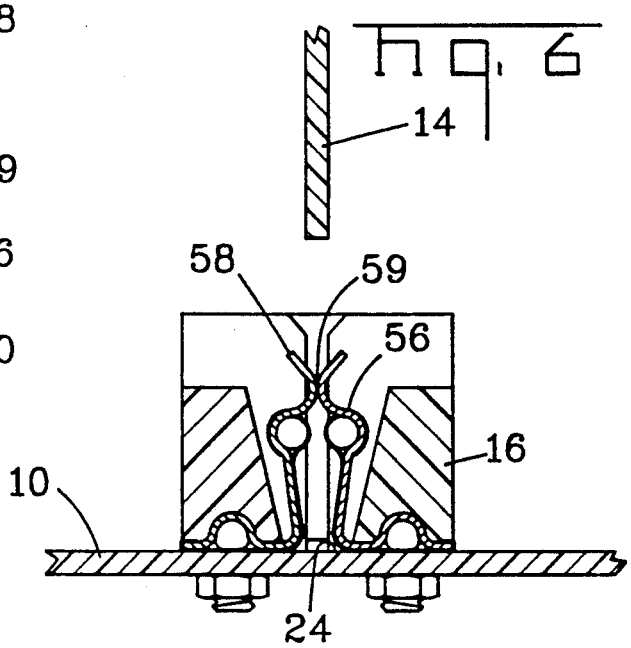
Figure 7:
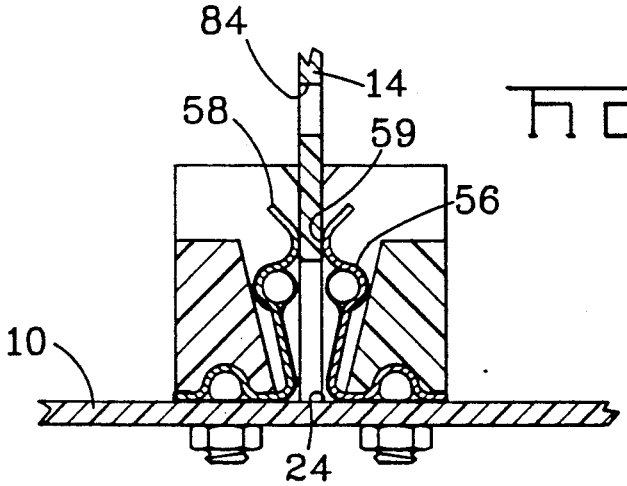

A feature of each such leg 54,56 is the provision of a longitudinally disposed grooves 60,62, for receiving compressible members 64,66, such as a rod-like member formed of an elastomeric material. FIG. 5 is an enlarged sectional view of a preferred L-shaped member 52, with the compressible members 64,66 lying within grooves 60,62. Further, it will be seen that a flexible film 70, containing circuitry 72 thereon, as shown in FIG. 2, is wrapped around the L-shaped members 52, as illustrated. That is, one film edge 74 is wrapped around and secured to the end 76 of leg 54, then arranged to lie taut and overlie compressible members 64,66 and finally again secured to the rear 78. By this arrangement the compressible members 64,66 may act to apply a force to the flexible film 70 to interconnect same to the mother or daughter board. Note the daughter board 14 insertion sequence illustrated in FIGS. 5–7, from unmated to partially mated to fully the mated position, respectively.

Figure 8:
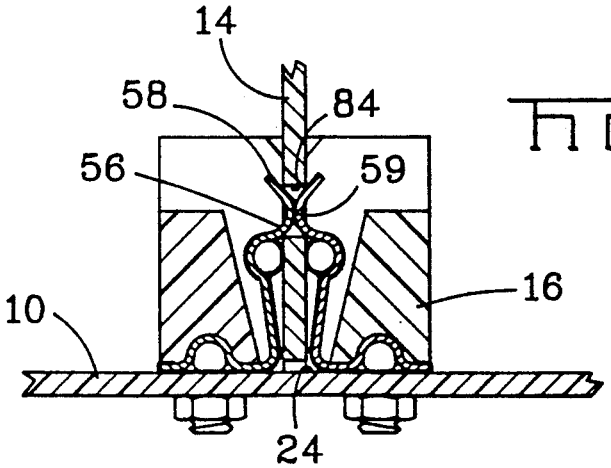

Considering further such sequence, it will be noted that the daughter board 14 includes a central slot 80 opening from the mating end 82 which receives the middle portion 32 in the fully mated position. Additionally, the daughter board 14 further includes plural holes 84 each aligned with and corresponding to a pair of ends 58. As the daughter board 14 is inserted into slot 20 (FIG. 7), the mating edge 82 contacts leg ends 58 causing the legs to spread. By the use of the narrow webs 41 between the L-shaped member 52 and the mounting post 38, such L-shaped member 52 can pivot or twist about the web 41 to allow insertion of the daughter board 14. As the insertion or mating operation continues, the camming surfaces 59 move laterally to receive the daughter board 14, the ride along the major surfaces thereof, outside the circuit traces or paths, until the daughter board 14 fully seats within the slot (FIG. 8). Full mating thereof is achieved when the holes 84 are laterally aligned between corresponding camming surfaces 59, and the legs 56 resile into a latching condition with the holes 84. The mating is achieved without damage to the flexible film.

Figure 9:
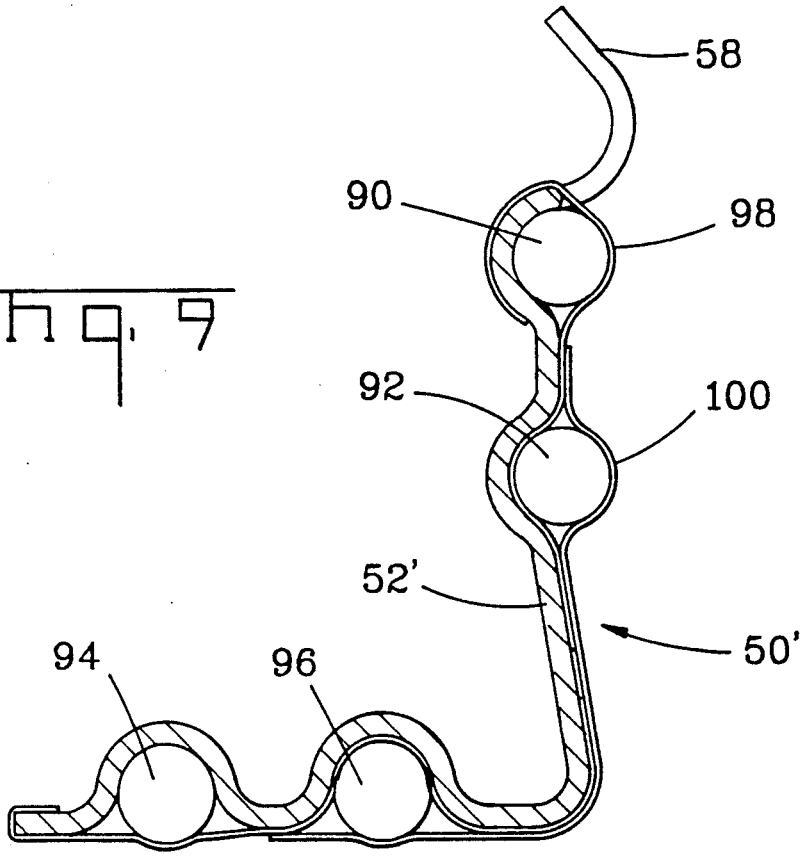
FIG. 9 is a sectional view similar to FIG. 5, illustrating a further embodiment of a resilient spring forming part of a force generating member.
Figure 10:
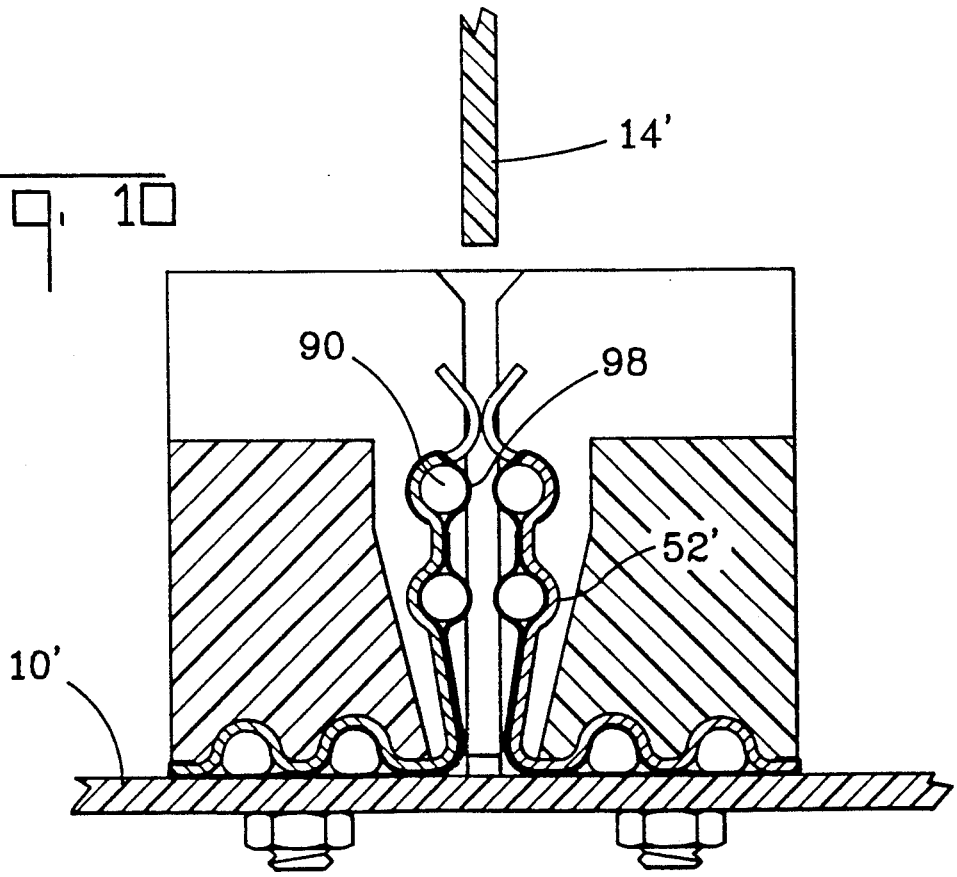
FIG. 10 is a sectional view of a backplane connector assembly incorporating the resilient spring of FIG. 9.

FIGS. 9 and 10 represent a further embodiment for a force generating member 50', where each leg of the L-shaped member 52' is provided with a pair of compressible members 90,92 and 94,96. Additionally, two separate flexible films 98,100 are provided, where as best illustrated in FIG. 9, the film 98 overlying compressible members 90 and 94 electrically interconnect the circuitry thereof, and the film 100 electrically interconnects the circuitry overlying compressible members 92 and 96. FIG. 10 illustrates the use of such modified force generating member to electrically interconnect a daughter board 14' to a mother board 10'.

We claim:

1. A backplane connector assembly of the type including a mother board, a connector housing mounted on said mother board, and a daughter board slidably insertable within said connector housing for electrical interconnection to said mother board, said assembly comprising an elongated connector housing having a pair of parallelly disposed spaced apart housing members defining at least one slot therebetween for receiving said daughter board, a force generating member disposed within said slot, said force generating member comprising a pair of resilient, essentially L-shaped members, where one leg of each said L-shaped member is fixedly disposed between said mother board and a respective one of said housing members, and the others of said legs upstand within said slot in a spaced apart relationship to receive said daughter board therebetween, said upstanding legs including a pair of opposing elastomeric members to apply a compressive pressure to said daughter board, and, a flexible circuit element mounted on said force generating member and operatively disposed to electrically interconnect said daughter board to said mother board.

2. The backplane connector assembly according to claim 1, wherein the ends of said upstanding legs include opposed, cooperating camming members operatively arranged to spread said legs when contacted by said daughter board.

3. The backplane connector assembly according to claim 2, wherein said daughter board is provided with a notch aligned with said leg ends whereby when the daughter board is fully inserted into said slot said upstanding legs will resile and said leg ends will seat within said notch.

4. The backplane connector assembly according to claim 1, wherein each said leg includes a laterally, oriented groove for receiving a respective said elastomeric member, and a respective said flexible circuit element member is in contact with a respective said elastomeric member.

5. The backplane connector assembly according to claim 4, wherein each said leg includes a pair of parallel grooves containing force generating elastomeric members, where the elastomeric members of a given pair arranged to apply pressure to a different said flexible circuit element.

6. The backplane connector assembly according to claim 1, wherein flange means are provided at the ends of each said L-shaped member to mount same to said mother board.

7. The backplane connector assembly according to claim 6, wherein a narrow web joins each said flange means to said L-shaped member to allow a lateral camming movement to said L-shaped member while said flange means is fixedly secured between said housing member and said mother board.

8. The backplane connector assembly according to claim 6, wherein a flange means is provided midway along the housing member between a pair of longitudinally aligned L-shaped members.

* * * * *